US005080352A

United States Patent [19]

Freed

[11] Patent Number: 5,080,352

[45] Date of Patent: Jan. 14, 1992

[54] MULTI-PURPOSE EXERCISE MACHINE

[76] Inventor: Mark L. Freed, 16301 Londelius St., Sepulveda, Calif. 91343

[21] Appl. No.: 688,893

[22] Filed: Apr. 22, 1991

[51] Int. Cl.[5] ..... A63B 1/00

[52] U.S. Cl. ..... 272/144; 272/62; 272/145

[58] Field of Search ..... 128/71, 75; 272/62, 272/63, 93, 144, 145

[56] References Cited

U.S. PATENT DOCUMENTS

| | | | |
|---|---|---|---|
| 3,891,207 | 6/1975 | Helliwell | 272/62 X |
| 4,611,806 | 9/1986 | Terry | 272/62 X |
| 4,703,929 | 11/1987 | Reed | 128/71 X |
| 4,838,250 | 6/1989 | Angelo | 272/144 X |
| 4,921,245 | 5/1990 | Roberts | 272/62 X |
| 4,927,135 | 5/1990 | Nieppola | 272/63 |

*Primary Examiner*—Robert Bahr
*Assistant Examiner*—Glenn Richman
*Attorney, Agent, or Firm*—Philip D. Junkins

[57] ABSTRACT

The present invention relates to a complete abdominal muscle exercise and workout machine for use by an individual to strengthen and develop the abdominal muscles. The machine is of light-weight and simple (but sturdy) construction, is of compact and portable design, and may be easily assembled into alternative forms for the performance and practice of a wide variety of hanging exercises, lying exercises and up and down exercises. The machine may be easily disassembled for storage and transportation purposes.

8 Claims, 2 Drawing Sheets

MULTI-PURPOSE EXERCISE MACHINE

FIELD OF THE INVENTION

The present invention relates to physical exercise machines. More particularly, the invention concerns physical exercise machines and apparatus designed and operated for the development of abdominal muscles through a variety of exercise routines.

BACKGROUND OF THE INVENTION

The skeletal-muscular system of the human body consists of the 206 bones and over 650 muscles that maintain the skeletal structure, protect and support the internal organs, and help the body move. During recent years a great deal of interest has been shown in the exercise of important body muscles for the development of specific strengths and physical abilities and for the development of desired body shapes and proportions. Particular attention has been devoted to the development of the chest muscles (pectoralis major), back muscles (trapezius), upper arm muscles (biceps and triceps), principal upper leg muscles (quadriceps femoris) and stomach muscles (rectus abdominus) through weight lift and force application and resistance exercise programs and machines. Amateur and professional athletes and body builders, both male and female alike, spend many hours per week in such exercise programs utilizing a broad range of apparatus from simple barbells to complex, sophisticated and expensive exercise machines. Although many of the complex and expensive body building exercise machines provide apparatus means for addressing and accomplishing stomach or abdominal exercises, the availability of such machines and there use is normally restricted to health clubs and commercially operated gyms. No simple and inexpensive arrangement of equipment has been provided for the complete development of stomach muscles outside of the health club or commercial gym environment, i.e., for individual home use.

OBJECTS OF THE INVENTION

It is therefore a principal object of the present invention to provide a multi-purpose exercise machine of simple construction for complete development of abdominal muscles.

It is another object of the invention to provide an exercise machine which is capable of being used by men and women of varying body size and structure in a safe and reliable manner to perform a wide variety of exercises to build up stomach muscles.

It is a further object of the invention to provide a low cost, multi-purpose stomach muscle exercise machine of light-weight and simple construction and which is of compact and portable design.

It is a still further object of the invention to provide an exercise machine through which a wide variety of abdominal muscle exercises may be practiced at home or elsewhere outside of commercial gym or health club facilities and which is of light-weight construct, is portable, is easily assembled at the point of use and may be stored upon disassembly in a minimum of space.

Other objects, features and advantages of the present invention will be apparent from the following summary and detailed description of the invention, taken in conjunction with the accompanying drawing figures.

SUMMARY OF THE INVENTION

The present invention relates to a complete abdominal muscle exercise and workout machine for use by an individual (man, woman or child, amateur or professional athlete or body builder) to strengthen and develop the abdominal muscles. The machine is of light-weight and simple (but sturdy) construction, is of compact and portable design, and may be easily assembled for use and disassembled for storage and transport purposes. The machine has as its principal structural assembly a sturdy and rigid framework comprised of: (a) two parallel elongated vertical legs (tubular metallic bars having a square cross-section); and (b) three laterally-extending crossbars (right-angle metallic members) which are bolted at their ends (through one of their legs) to the parallel vertical legs at spaced intervals. The upper (head-end) crossbar and the intermediate crossbar each include a centrally positioned notch on the angle leg bolted to the parallel vertical legs and the intermediate crossbar and lower crossbar each include a centrally positioned hook hole on the angle leg which projects outwardly from the parallel vertical legs.

An elongated padded backboard member is removably affixed to the front side of the framework assembly by backboard screws which are positioned in the notches of the upper and intermediate crossbars when the abdominal muscle exercise machine of the invention is to be utilized to perform exercises including hanging leg raises, hanging knee raises and hanging side raises. "L" shaped arm bars, of metallic tube structure (square cross-section), bearing arm pads along the outer surface of the long leg of the "L" bars, are removably positioned at the upper ends of the elongated legs of the framework assembly by insertion of the short legs of the "L" bars into the legs of the framework assembly. With this arrangement, the long legs of the "L" shaped arm bars extend forwardly from the framework assembly. A hook is provided in the upper end portion of the backboard, on the backside thereof, whereby the exercise machine assembly (as described above) may be affixed to a wall or other support means to maintain the machine in a stable upright position during the performance of hanging exercises by a person using the machine.

The abdominal muscle exercise machine assembly of the invention, as described above, may be readily altered so that the padded backboard member of the assembly resides on the backside of the framework structure and acts as a padded platform. Thereafter, when the exercise machine is placed on a floor surface (or the ground) with the arm bars projecting downwardly into contact with the floor or ground, the machine assumes an inclined orientation. In such inclined orientation, the user of the machine may perform a variety of lying exercises (leg raises and knee raises) and up and down exercises (twisting incline sit-ups, Roman chair style sit-ups and hyperextension side-ups) to develop and strengthen the users abdominal muscles. Finally, with the padded backboard member of the assembly on the backside of the framework structure, and with the arm bars removed from the tubular legs of the framework, the resulting assembly when positioned in complete horizontal orientation with respect to the floor or ground (with the backboard acting as a padded platform) may be used to perform additional stomach muscle development exercises such as quarter sit-ups.

In the inclined and horizontal orientations of the exercise machine of the invention the padded backboard, acting as a padded platform, may assume two different positions on the framework assembly via placement of the backboard hook into either the hook hole in the lower crossbar or into the hook hole of the intermediate crossbar. The backboard is prevented from moving with respect to the framework assembly because of the hook placement in a hook hole of the intermediate or lower crossbar and through a backboard block which engages the upper surface of the projecting angle leg of the upper or intermediate crossbar, respectively.

An appropriate abdominal muscle strengthening and development program, using the exercise machine of the present invention, includes a regimen of the variety the exercises in sets of repeats as a beginner, intermediate and advanced user.

BRIEF DESCRIPTION OF THE DRAWING FIGURES

The above and other features and advantages of the invention are illustrated in the accompanying drawing figures in which:

FIG. 1 is a perspective elevation view of the abdominal muscle exercise machine of the invention in substantially complete assembled condition (with the padded backboard mounted to the frame in it uppermost position and the arm bars ready for insertion into the upper ends of the elongated vertical legs of the frame of the machine) and with the machine positioned in vertical orientation ready for affixation to a supporting wall and thereafter for use in the performance of a series of hanging exercises;

FIG. 2 is a perspective elevation view of the abdominal muscle exercise machine with the backboard mounted to the frame in a reverse and lower position and with the arm bars inserted into the upper ends of the elongated vertical legs of the frame with the padded leg portions of the arm bars crossed over one-another whereby the machine is assembled in inoperative form ready for transport or upright or horizontal storage in a minimum of storage space;

Figure 5:
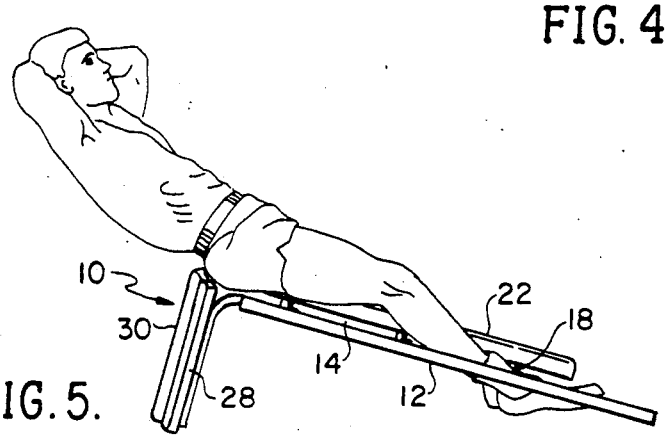
Figure 6:
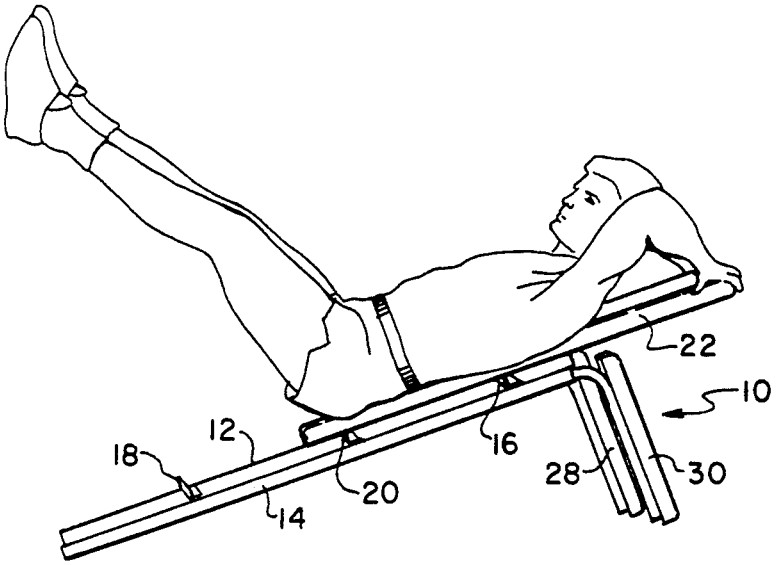

FIG. 5 is a side perspective view of the abdominal muscle exercise machine in its inclined orientation (with the backboard in a lower position on the backside of the frame assembly for use as a padded lower body support platform) and in use by an exercising person during the performance of incline sit-ups; and FIG. 6 is a side perspective view of the abdominal muscle exercise machine in its inclined orientation (with the backboard in an upper position on the backside of the frame assembly for use as a padded upper body support platform) and in use by an exercising person during the performance lying leg raises.

DETAILED DESCRIPTION OF THE INVENTION

Figure 1:
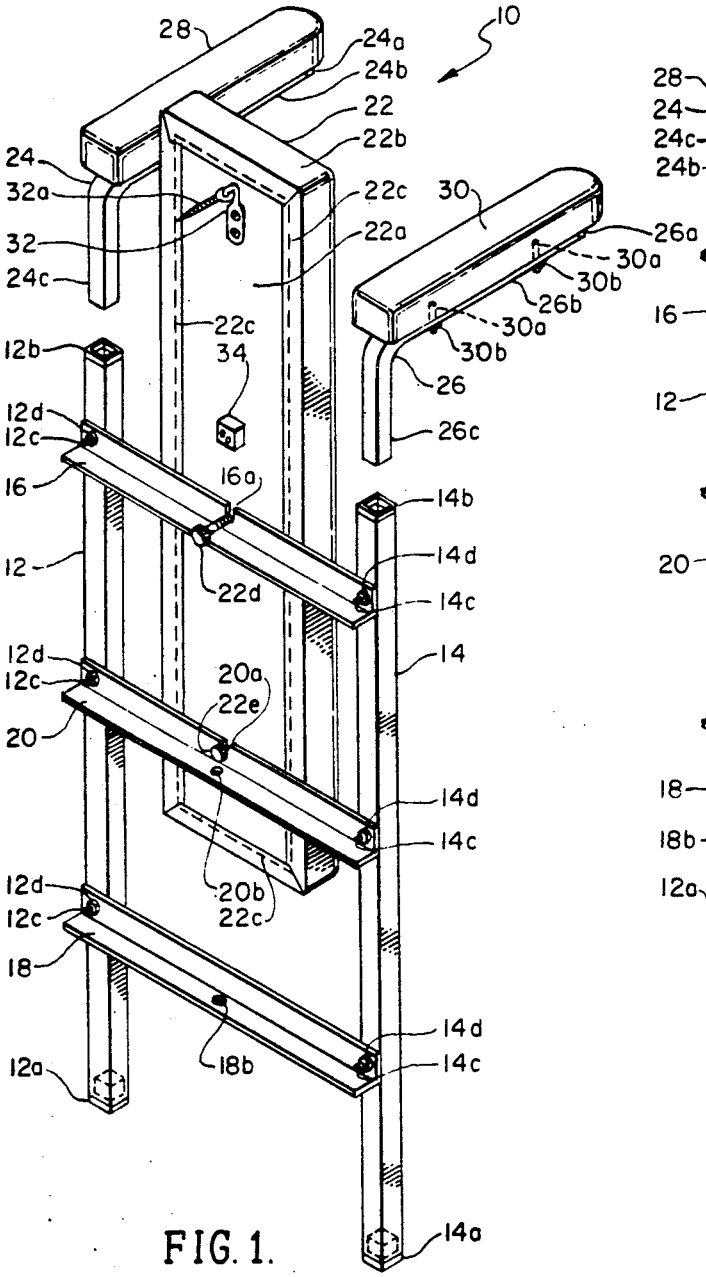

A preferred embodiment of the abdominal muscle exercise machine of the invention (for use in the performance of a series of hanging exercises) is shown in a perspective view in FIG. 1 of the drawing sheets. The machine, generally indicated by the numeral 10, has as its principal structural assembly a sturdy and rigid framework comprised of: (a) two parallel elongated vertical leg members 12 and 14; and (b) three laterally-extending crossbars 16, 18 and 20 which are bolted at their ends to the parallel vertical leg members. The leg members 12 and 14 are preferably formed from tubular metallic bars having a square cross-section. The leg members are provided at their respective lower ends with inserted finishing plugs or floor caps **12*a* and 14*a* and at their respective upper ends with inserted end sleeves or arm connector members 12*b* and 14*b*. The crossbars 16, 18 and 20 are preferably formed from right-angled metallic members and are positioned at spaced intervals along the leg members 12 and 14. Thus, the upper or head-end crossbar 16 is bolted to the leg members 12 and 14 respectively by bolts 12*c* and 14*c* with accompanying nuts 12*d* and 14*d*. The lower or foot end crossbar 18 is also bolted to the leg members 12 and 14 respectively by bolts 12*c* and 14*c* and accompanying nuts 12*d* and 14*d*. Finally, the intermediate crossbar 20 is bolted to the leg members 12 and 14 by a like combination of bolts and nuts. The upper crossbar 16 and the intermediate crossbar 20 each include a centrally positioned notch 16*a* and 20*a*, respectively, on the angle leg bolted to the parallel vertical legs 12 and 14, and the intermediate crossbar 20 and the lower crossbar 18 each include a centrally positioned hook hole 20*b* and 18*b*, respectively, on the angle leg which projects outwardly from the parallel vertical legs 12 and 14**. The purpose and function of such notches and hook holes in the crossbars will be described hereinafter.

An elongated padded backboard member 22 is removably affixed to the front side of the framework assembly by means described hereinafter. The backboard member 22 is comprised of a rigid board member **22*a* which bears on its front side padding material (not shown but consisting of foam plastic or foam rubber material) covered by an impervious sheet fabric material or sheet plastic material 22*b* which is affixed to the rear side of board member 22*a* by a peripheral line of staples 22*c* or other appropriate fastener means. The means for removably affixing the backboard 22 to the front side of the framework assembly comprises bolts 22*d* and 22*e* which respectively are positioned in the notches 16*a* and 20*a* of the crossbars 16 and 20. These bolts are threaded into nut inserts (not visible) which are appropriately affixed into the backside of board member 22*a* of the backboard 22**.

"L" shaped are members 24 and 26 of metallic tube structure (square cross-section) are removably positionable in the upper ends of the elongated legs 12 and 14 (respectively) of the framework assembly of the exercise machine 10 of the invention. The "L" shaped arm members 24 and 26 include (respectively) arm caps or plugs **24*a* and 26*a* at the ends of the long legs or arm support portions 24*b* and 26*b* of such members. The short legs 24*c* and 26*c* of the arm members are insertable into the elongated legs 12 and 14 of the framework assembly to yield the arm members positionable as described hereinafter. The arm support portions 24*b*** and 26*b* of the arm members 24 and 26 bear arm pads 28 and 30 (respectively) along the outer/upper surface of such arm support portions. The arm pads 28 and 30 are affixed to the associated arm support portions of arm members 24 and 26 (respectively) via bolts 28*a* and 30*a* which extend through such arm support portions and receive locking nuts 28*b* and 30*b*. Only bolts 30*a* and nuts 30*b* are visible in FIG. 1.

A hook member 32 is provided on the backside of the backboard 22 proximate the upper end thereof. The hook member 32 is designed and positioned such that it properly interacts with a threaded hook holder 32*a*. The hook holder 32*a* is screwed into a supporting wall (or other available support means) to hold the abdominal muscle exercise machine of the invention in an upright operating position for the practice of a regimen of varying hanging exercises by a person using the machine. The backboard 22 is also provided with a backboard block 34 affixed to the backboard proximate the middle thereof. The function of the backboard block 34 will become apparent with the description of the alternative form of the abdominal muscle exercise machine of the invention as illustrated in FIG. 3.

Figure 2:
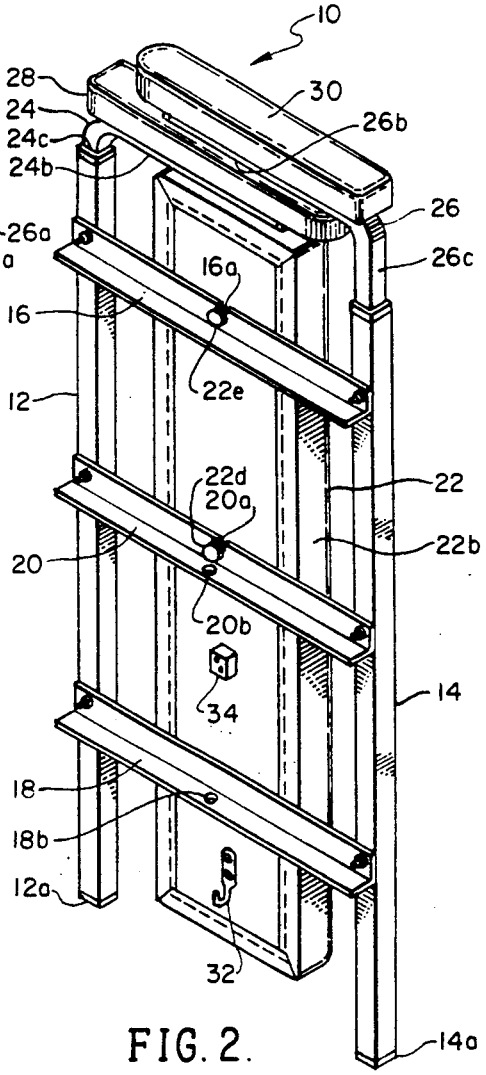

Referring now to FIG. 2 of the drawing sheets there is shown in a perspective elevation view the abdominal exercise machine 10 in disassembled and inoperative compact orientation ready for easy transport or storage in a minimum of storage space. In such orientation the backboard 22 has been remounted to the frame assembly in a reverse and lower position and the "L" shaped arm members 24 and 26 have been removed and reinserted into the upper end of the elongated vertical legs of the frame assembly with the arm support portions 24*b* and 26*b* (including their respective arm pads 28 and 30) of the arm members crossed over one-another. It will be noted that in this transport and/or storage orientation the bolt 22*d* now rests in notch 20*a* of the intermediate crossbar 20 and the bolt 22*e* now rests in notch 16*a* of the upper crossbar 16.

Figure 3:
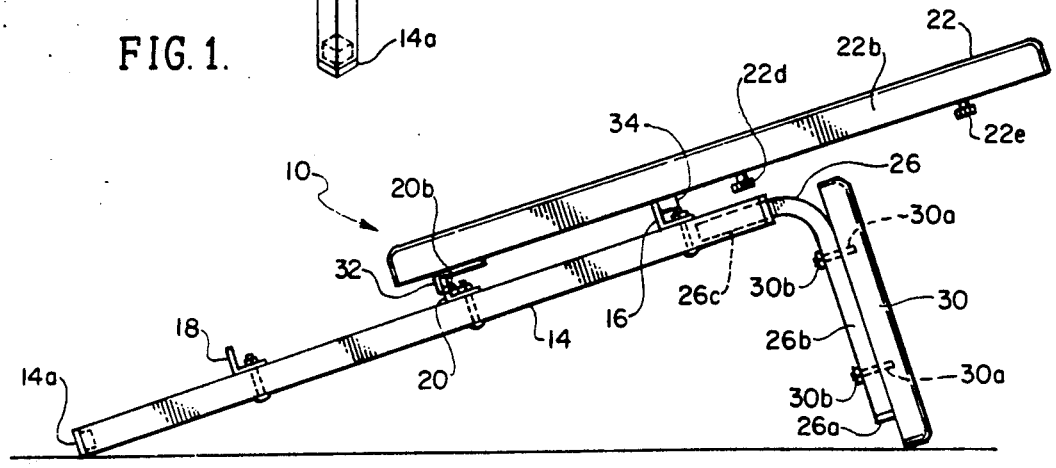
FIG. 3 is a side elevation view of the abdominal muscle exercise machine in inclined orientation with the padded backboard mounted to the backside of the frame in its uppermost position and with the machine ready for use in the performance of a series of lying exercises including leg raises and knee raises.

In FIG. 3 there is shown in a side elevation view an alternative and operative form of the abdominal muscle exercise machine 10 of the invention. In such view the padded backboard 22 has been mounted to the backside of the frame assembly and the framework assembly, with the "L" shaped arm members 24 and 26 inserted into the upper ends of the elongated legs 12 and 14 of the framework assembly, has been tilted to the ground or floor so that the arm support portions 24*b* and 26*b* of the arm members (with their respective arm pads 28 and 30) support the framework assembly of the exercise machine 10 and in an inclined position. In such orientation the padded backboard 22 acts as an inclined padded body support platform with the machine ready for use in the performance of a series of lying exercises (including leg raises and knee raises) to further strengthen and develop the abdominal muscles of the exercising user of the machine. As shown in FIG. 3 the backboard 22 has been placed in reverse orientation with respect to the machine's framework assembly (on the backside thereof). The backboard (now positioned to act as a body support platform) is positioned upwardly on the framework assembly and extends well beyond the arm members 24 and 26. It is affixed to the framework assembly by placement of the hook member 32 of the backboard into the hook hole 20*b* of the intermediate crossbar 20 and thereafter snapping the backboard block 34 into abutting fitment against the upper surface of the outwardly projecting angle leg of the upper crossbar 16. In performing lying exercises on the machine 10 in its alternative form as shown in FIG. 3 the center of body weight of the exercising user is located over the platform (backboard 22) and above the location of the upper crossbar 16 whereby the platform is precluded from rotating about the upper crossbar by the hook member 32 in its placement position in hook hole 20*b* of the intermediate crossbar 20. Further, the platform is precluded from shifting on the framework assembly by the hook member 32 and the backboard block 34.

It should be noted that the position of the body support platform (padded backboard 22) on the framework assembly of the abdominal muscle exercise machine 10 (in the machine's tilted orientation as illustrated in FIG. 3) may be shifted downwardly on the framework assembly. Thus, the platform may be placed so that the hook member 32 engages the hook hole 18*b* in the lower crossbar 18 and so that the backboard block 34 is snapped into abutting fitment against the upper surface of the outwardly projecting angle leg of the intermediate crossbar 20. When the padded platform (backboard 22) is so placed the exercise machine in its tilted orientation (with inclined platform) may be used in the performance of a series of up and down exercises (including incline sit-ups, Roman chair sit-ups and hyperextension side-ups) to further develop and strengthen the users abdominal muscles.

Figure 4:
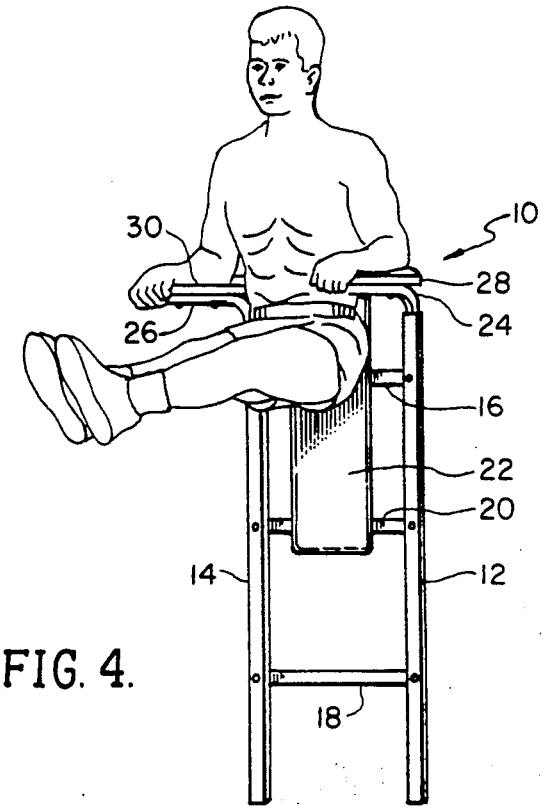
FIG. 4 is a front perspective view of the abdominal muscle exercise machine of the invention in its vertical orientation and in use by an exercising person during the performance of hanging leg raises.

To further illustrate the versatility of the abdominal muscle exercise machine and apparatus of the present invention there is shown in FIGS. 4, 5 and 6 perspective views of the alternative forms of the apparatus in use by an exercising person performing a typical exercise adaptable to each apparatus form. Thus, in FIG. 4 there is illustrated in a front perspective view the exercise machine 10 of the invention in its vertical orientation and form in use by an exercising person during the performance of hanging leg raises. It is to be noted that a supporting wall or other machine support means (to which the backboard hook member is affixed to maintain the machine in steady vertical position) is not illustrated in such figure.

In FIG. 5 there is illustrated, in a side perspective view, the alternative form of the exercise machine 10 of the invention in inclined orientation with the backboard 22 mounted to the backside of the machine framework assembly and acting as a lower body support platform. The platform is positioned downwardly on the framework assembly and the exercising person is shown during the performance of an incline sit-up with the exerciser's lower leg members positioned along the side of the platform inside of the elongated leg members 12 and 14 and with his feet hooked under the lower crossbar 18.

In FIG. 6 there is illustrated, in a side perspective view, the alternative form of the exercise machine 10 in inclined orientation with the backboard 22 mounted to the backside of the machine framework assembly and acting as an upper body support platform. The platform is positioned upwardly on the framework assembly (as shown in FIG. 3) and the exercising person is shown during the performance of a lying leg raise with the exerciser's upper body structure positioned on the platform. The exerciser is precluded from sliding down the inclined platform during the exercise regime by gripping the upper edge portion of the platform with his hands.

It should be understood that, although not illustrated, additional abdominal muscle exercises may be performed utilizing the apparatus of the invention in further configurations. For example, the "L" shaped arm members 24 and 26 may be removed from insertion into the upper ends of the elongated legs 12 and 14 of the framework assembly and the framework assembly with the padded backboard 22 positioned as shown in FIG. 5 may be placed on the ground or a floor to provide a horizontal padded platform upon which stomach muscle exercises, including quarter sit-ups, may be performed with comfort and support to the exerciser's back.

While the invention has been described in connection with particular structural form embodiments for the performance of a wide range and type of abdominal muscle development and strengthening exercises, many modifications of the apparatus will be apparent to those skilled in the art. Accordingly, such modifications are to be included within the spirit and scope of the invention as defined by the following claims.

What I claim is:

1. An exercise machine for the strengthening and development of the abdominal muscles through the performance of hanging, lying and sit-up exercises comprising:

(a) a rigid frame including a pair of elongated, parallel leg members extending from the head end to the foot end thereof, and upper, intermediate and lower crossbar members extending between and affixed to said leg members and spaced along said leg members at the rear side thereof from the head end to the foot end of said frame;

(b) a backboard, including padding on the face side thereof, adaptable to be removably affixed to the crossbar members of said frame from the face side of said frame in a position between the leg members thereof during the performance of hanging exercises on said machine, and adaptable to be removably affixed to the crossbar members of said frame on the rear side thereof during the performance of lying and sit-up exercises on said machine; and (c) a pair of "L" shaped arm bars each bearing arm padding material on the outer surface of the long leg thereof and each being adapted in its short leg for removable connection to the head end of an elongated leg member in an orientation so that the long legs thereof project forwardly from the frame, the long legs of said "L" shaped bars with associated arm padding material providing arm support means for an exercising person performing hanging exercises on the exercise machine when the frame of said machine is supported by the foot ends of said elongated leg members with the frame in a vertical orientation, and the long legs of said "L" shaped bars, together with the foot ends of said elongated leg members, providing floor support for said frame and an inclined orientation thereto when the backboard is removably affixed to the crossbar members of said frame on the rear side thereof with its padded face acting as a body support platform for an exercising person performing lying and sit-up exercises on the exercise machine in said inclined orientation.

2. An exercise machine for the strengthening and development of abdominal muscles as claimed in claim 1 wherein the elongated, parallel leg members of the rigid frame are formed of metallic tubes having a square cross-section and the crossbar members thereof are formed of right-angle metallic beams which are bolted at their ends to said elongated leg members.

3. An exercise machine for the strengthening and development of abdominal muscles as claimed in claim 2 wherein the pair of "L" shaped arm bars are formed of metallic tubes having a square cross-section and of cross-sectional dimensions whereby the short legs thereof may be slipped within the head ends of said elongated leg members of said frame to provide for the removable connection of said arm bars to said leg members.

4. An exercise machine for the strengthening and development of abdominal muscles as claimed in claim 1 wherein the backboard is provide on its rear side with a hook member whereby the exercise machine when oriented in a vertical position and supported at the foot ends of said elongated leg members may be attached to a supporting wall or other support means to maintain its vertical orientation during the performance of hanging exercises by an exercising person.

5. An exercise machine for the strengthening and development of abdominal muscles as claimed in claim 1 wherein the crossbar members of the rigid frame are formed of right-angle metallic beams with one of the angle legs of each such beams being bolted at its ends to the elongated leg members of said frame and the upper and the intermediate crossbar members of the frame, in the angle leg affixed to said elongated leg members, include a centrally positioned notch, and wherein the backboard in its rear side has a pair of bolts which are positioned to align with and seat in the notches in the upper and intermediate crossbar members whereby the backboard may be removably affixed to said crossbar members of said frame from the face side of the frame in a position between the leg members thereof during the performance of hanging exercises on said machine.

6. An exercise machine for the strengthening and development of abdominal muscles as claimed in claim 1 wherein the crossbar members of the rigid frame are formed of right-angle metallic beams with one of the angle legs of each such beams being bolted at its ends to the elongated leg members of said frame and the intermediate and the lower crossbar members of the frame, in the angle leg which projects outwardly from the elongated leg members, include a centrally positioned hook hole, and wherein the backboard in its rear side is provided with a hook member and with a backboard block which are positioned so that when the backboard is placed on the rear side of the frame it may be removably affixed thereto in two positions by either attachment of said hook to the hook hole of the intermediate crossbar member and abutting the backboard block to the upper surface of the angle leg of the upper crossbar member which projects outwardly from the elongated leg members of the frame whereby said machine may be used for incline lying exercises, or by attachment of said hook to the hook hole of the lower crossbar member and abutting the backboard block to the upper surface of the angle leg of the intermediate crossbar member which projects outwardly from the elongated leg members of the frame whereby said machine may be used for incline sit-up exercises.

7. An exercise machine for the strengthening and development of abdominal muscles as claimed in claim 1 wherein the backboard is removably affixed to the upper and intermediate crossbar members of said frame on the face side thereof and extends in its upper portion above the head ends of elongated leg members of said frame and above the long legs of the "L" shaped arm bars connected to the head ends of the elongated leg members of said frame.

8. An exercise machine for the strengthening and development of abdominal muscles as claimed in claim 1 wherein the backboard is removably affixed in reversed orientation to the upper and intermediate cross-bar members of said frame on the face side thereof and extends over its entire length between the elongated leg members of said frame and the "L" shaped arm bars in their short legs are removably connected to the head ends of the elongated leg members and oriented so the long legs of said arm bars overlap one-another whereby said machine may be easily transported or stored in a minimum of storage space.

* * * * *